US006218911B1

(12) United States Patent
Kong et al.

(10) Patent No.: US 6,218,911 B1
(45) Date of Patent: Apr. 17, 2001

(54) PLANAR AIRBRIDGE RF TERMINAL MEMS SWITCH

(75) Inventors: Alvin M. Kong, Manhattan Beach; Robert B. Stokes, Rancho Palos Verdes; Joseph P. Trieu, Huntington Beach; Rahil U. Bhorania, Torrance; Michael D. Lammert, Manhattan Beach, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/352,999

(22) Filed: Jul. 13, 1999

(51) Int. Cl.[7] ..... H01H 59/00
(52) U.S. Cl. ..... 333/101; 333/262; 200/181
(58) Field of Search ..... 333/101, 105, 333/262; 200/181

(56) References Cited

U.S. PATENT DOCUMENTS 4,740,410 4/1988 Muller et al. ..... 428/133
5,121,089 6/1992 Larson ..... 333/107
5,168,249 * 12/1992 Larson ..... 200/181 X
5,619,061 4/1997 Goldsmith et al. ..... 257/528
6,020,564 * 2/2000 Wang et al. ..... 200/181

* cited by examiner

*Primary Examiner*—Justin P. Bettendorf
(74) *Attorney, Agent, or Firm*—Michael S. Yatsko

(57) ABSTRACT

An RF switch and a process for fabricating an RF switch which includes multiple throws and can be fabricated utilizing only a single layer of metallization. The switch in accordance with the present invention includes an airbridge suspended beam disposed adjacent to one or more metal traces. One or more control pads are disposed adjacent to the airbridged suspended beam to operate the switch electrostatically. The suspended beam as well as the metal traces and contact pads are all fabricated with a single metallization layer. The switch is configured such that deflection of the beam is in a plane generally parallel to the plane of the substrate. By eliminating multiple metallization layers, the complexity for fabricating the switch is greatly reduced. Moreover, the switch configuration also allows multiple throws and multiple poles using a single level of metallization.

10 Claims, 6 Drawing Sheets

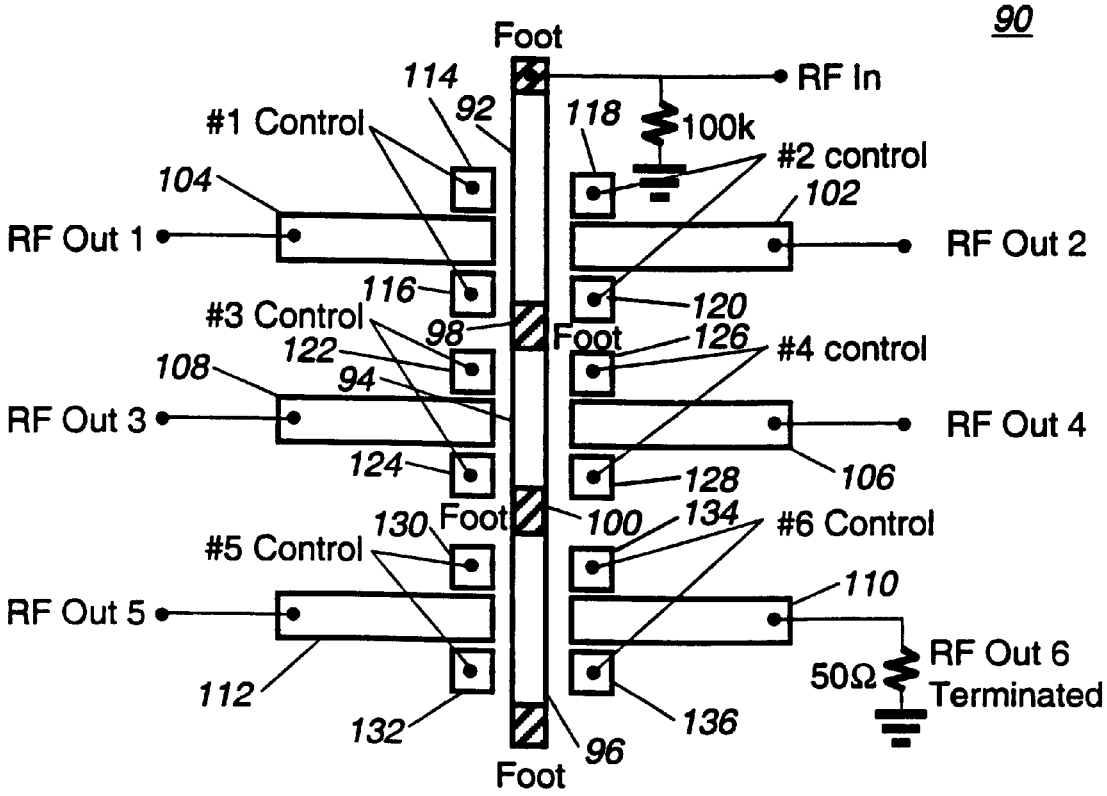
Figure 6
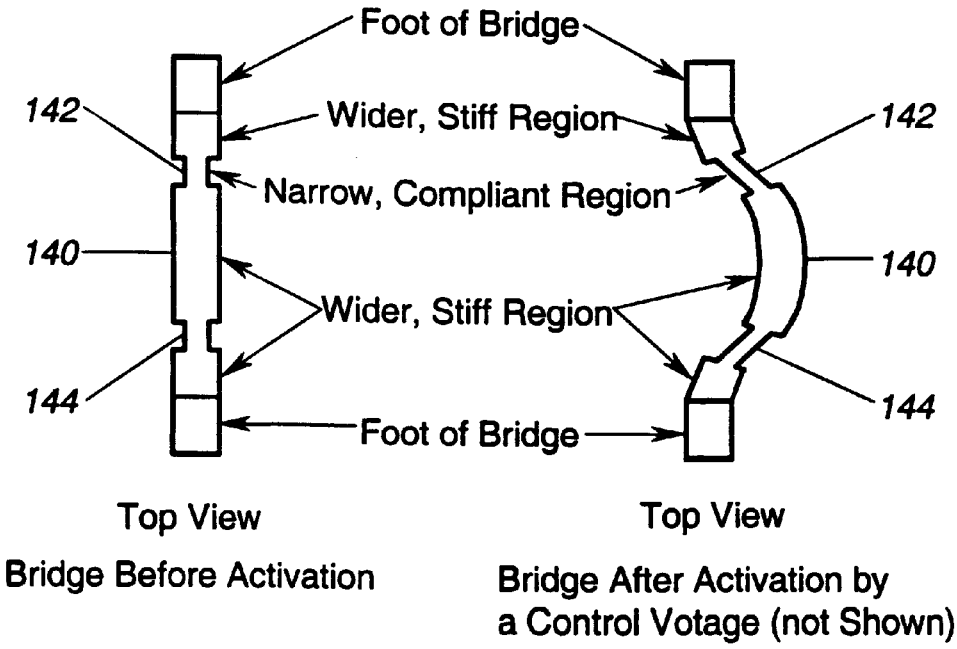
Figure 7a
Figure 7b

PLANAR AIRBRIDGE RF TERMINAL MEMS SWITCH

BACKGROUND OF THE INVENTION

1. Field of the Invention

The present invention relates to an RF switch and a process for making an RF switch and more particularly, to an RF switch fabricated by way of microelectromechanical system (MEMS) technology which includes a planar airbridge which allows for switch deflection in a single plane generally parallel to the substrate and thus only requires a single level of metallization, greatly simplifying the fabrication of the switch relative to known switches.

2. Description of the Prior Art

RF switches are used in a wide variety of applications. For example, such RF switches are known to be used in variable RF phase shifters; RF signal switching arrays; switchable tuning elements as well as in gang switching of voltage control oscillators (VCO). In order to reduce the size and weight of such RF switches, microelectromechanical system (MEMS) technology has been known to be used to fabricate such switches. MEMS technology is a process for fabricating various components using micromaching in a very similar manner as integrated circuits are fabricated.

Switches fabricated using MEMS technology normally include a substrate with one or more metal traces and control pads. An airbridged beam is known to be formed over the substrate in order to form one or more contacts with one or more of the metal traces; however, with only a single throw. Such switches normally require multiple levels of metallization.

Electrostatic forces are known to be used to control the opening and closing of the contacts. In particular, the control pad is connected to an external source of DC voltage. When the DC voltage is applied to the control contact, electrostatic forces cause the beam to deflect and make contact with one of the contacts, thus closing the circuit between the metal trace and the beam which define an RF contact. When the DC voltage is removed from the control pad, in some known switches, the resiliency of the beam causes it to deflect back to its normal position. In other known switches, electrostatic force is required to return the beam to the normal position. With such switches, the deflection of the beam is normally in a plane generally perpendicular to the plane of the substrate.

U.S. Pat. No. 5,619,061 and in particular FIGS. 18A–18D of the '061 patent discloses an RF switch with a single pole configuration, formed from multiple levels of metallization. In particular, the '061 patent discloses an RF switch which includes a beam suspended on opposing edges by thin metal hinges. More particularly, the beam is spaced apart from the substrate and suspended about midway along each edge by way of thin metal hinges. Metal traces are applied to the substrate and aligned with the edges of the beam. Control pads are disposed on the substrate adjacent the metal traces. Application of a DC voltage to the control pads causes an electrostatic attraction force to rotate the beam clockwise or counter clockwise and make contact with one of the metal traces on the substrate.

There are several known disadvantages of such RF switches. For example, such switches require a minimum of two levels of metal deposition, which adds to the complexity of the fabrication process. In addition, such switches are known to require relatively high voltages, typically 20–30 volts to operate. The relatively high voltage requirement is due to either the limited length of the airbridge, limited because of the possibility of collapsing, or due to the large distance between the beam and the DC control pad. Because of the possibility of foreign particles getting underneath the metal flap or membrane, such switches are normally limited to single throw designs because more throws normally require additional complicated metal deposition steps which could collapse onto lower levels. In addition, one of the failure mode for these kinds of switch is so called "sticking on", the switches stay at "on" position permanently. Thus, there is a need to provide an RF switch which has multiple throws that is amenable to being fabricated using MEMS technology which is less complicated to fabricate, remedy "sticking on" problem, and only requires a single level of metallization.

SUMMARY OF THE INVENTION

Briefly, the present invention relates to an RF switch and a process for fabricating an RF switch which includes multiple throws that can be fabricated utilizing only a single layer of metallization. The switch in accordance with the present invention includes one or more airbridge suspended beams disposed adjacent one or more metal traces. One or more control pads are disposed adjacent the airbridged suspended beam to operate the switch electrostatically. The suspended beam as well as the metal traces and contact pads are all fabricated with a single metallization layer. The switch is configured such that deflection of the beam is in a plane generally parallel to the plane of the substrate. By eliminating multiple metallization layers, the complexity for fabricating the switch is greatly reduced. Moreover, the switch configuration also allows multiple throws and multiple poles using a single level of metallization.

DESCRIPTION OF THE DRAWINGS

These and other advantages of the present invention will be readily understood with reference to the following specification and attached drawing wherein:

FIG. 6 is a top view of another alternate embodiment of the switch in accordance with the present invention illustrating the switch with multiple throws and multiple poles.

FIGS. 7A and 7B are end views of an alternate airbridge for use with the present invention.

DETAILED DESCRIPTION

The present invention relates to an RF switch amenable to being fabricated using microelectromechanical switch (MEMS) technology. In accordance with an important aspect of the invention, the switch deflection is generally in a plane generally parallel to the plane of the substrate. The switch in accordance with the present invention can be fabricated using only a single level of metallization in various configurations including single pole single throw as well as multiple pole multiple throw, thus simplifying the fabrication process as well as reducing the cost of the switch.

Figure 1:
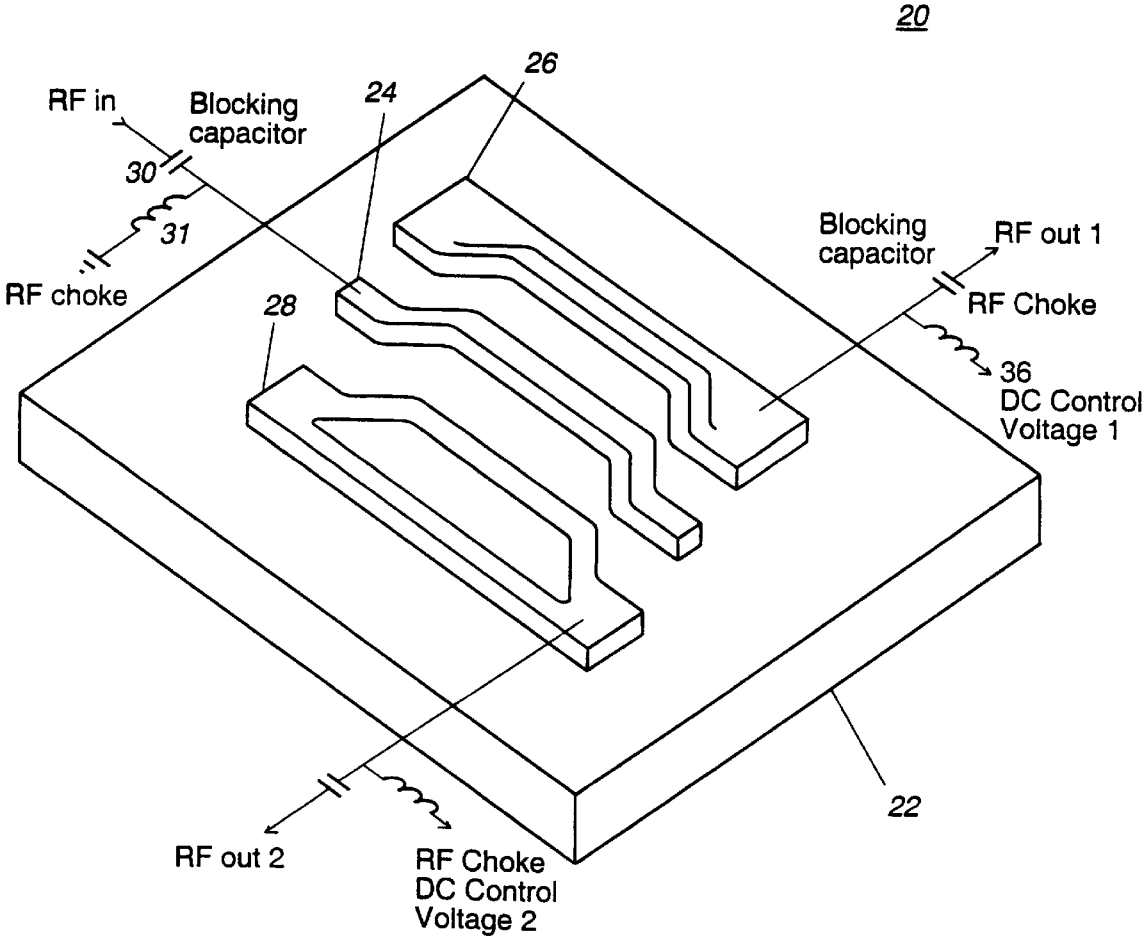
FIG. 1 is a perspective view of a single pole double throw capacitive type switch in accordance with the present invention.

Referring to FIG. 1, a perspective view of the switch in accordance with the present invention is illustrated and generally identified with the reference numeral 20. The switch 20 is formed on a generally planar insulating substrate 22, such as quartz or a semiconducting substrate, such as Gallium Arsenide (GaAs), which may be covered with a layer of insulating film (not shown) on the top to prevent current leakage. As shown, the switch 20 includes a beam 24 formed as an airbridge disposed adjacent to one or more spaced apart parallel metal traces 26 and 28. Electrostatic forces may be used to deflect the airbridge 24 to make contact with one of the metal traces 26 or 28. Portions of the traces 26 and 28 may be raised to the same height as the airbridge 24 to maximize the electrostatic force and contact area. More particularly, an RF input $RF_{in}$ is applied to the beam 24, for example, by way of an external blocking capacitor 30 which may be terminated by a choke 31 or terminating resistor 32 to ground. An RF output terminal $RF_{out}$ is connected to the metal trace 26.

Figure 2:
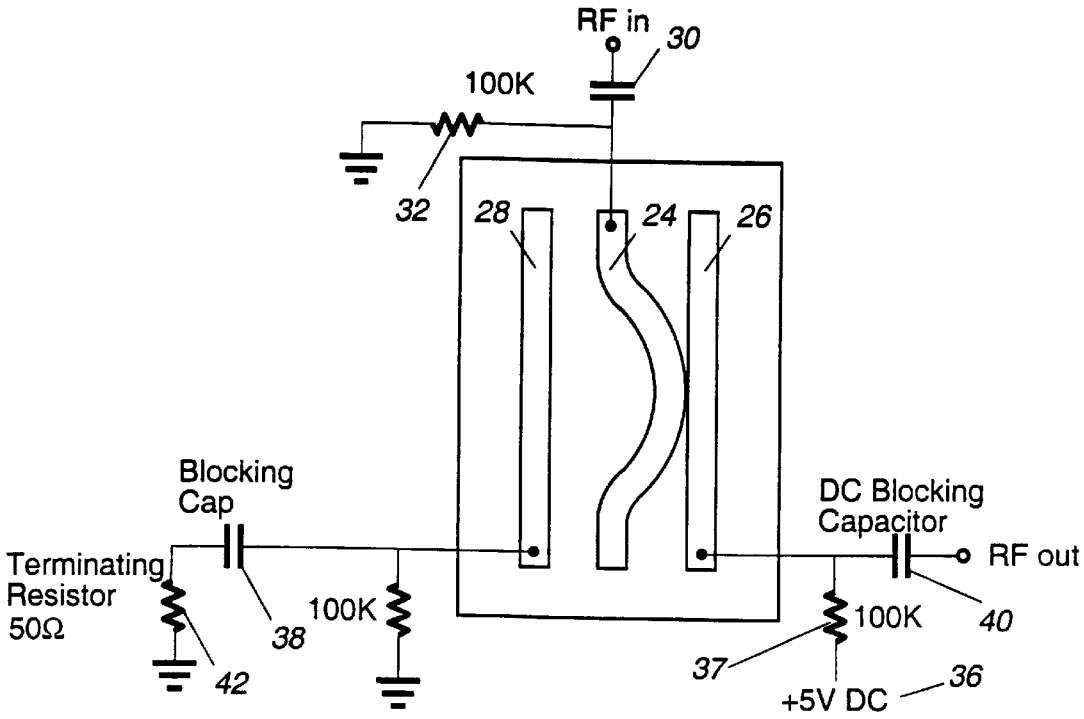
FIG. 2 is a top view of the switch illustrated in FIG. 1, shown in an on position.
Figure 3:
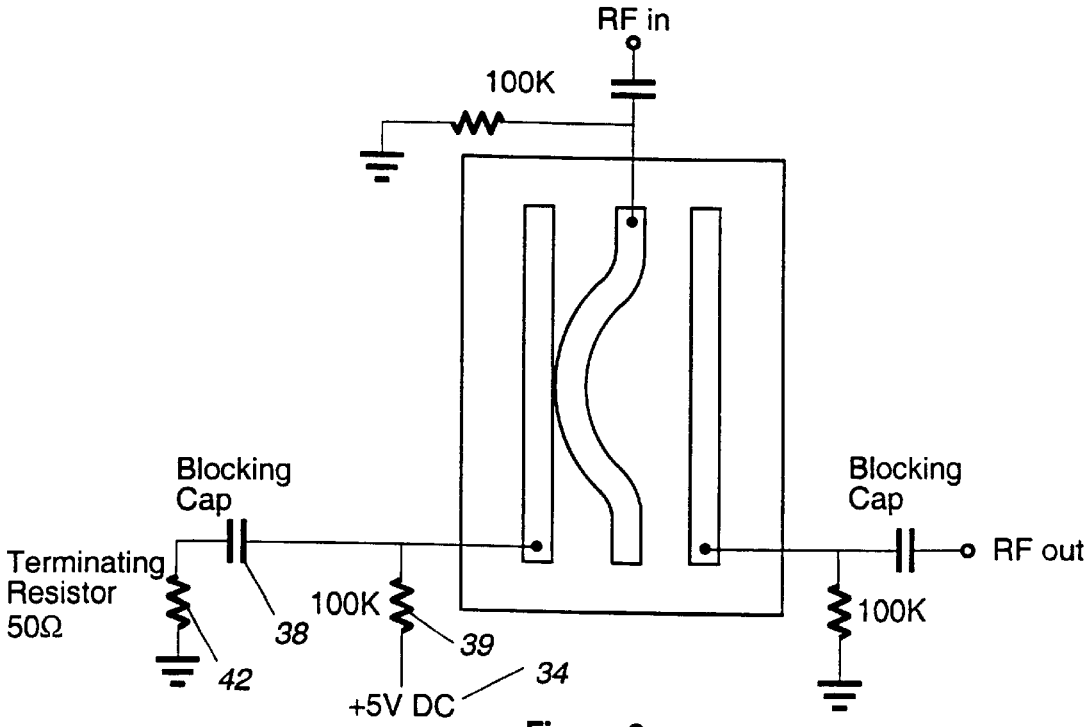
FIG. 3 is a top view of the switch illustrated in FIG. 1, shown in an off position.

In this embodiment, the metal traces 26 and 28 have a dual purpose. In particular, the metal traces 26 and 28 together with the beam 24 act as AC electrical contacts as well as DC control pads. In particular, as illustrated in FIGS. 2 and 3, the metal traces 26 and 28 may be connected to a pair of DC voltage sources 34 and 36 by way of a pair of relatively high value resistors 37, 39 which serve to insulate the RF signal from DC, and terminated by way of a pair of blocking capacitors 38 and 40 and termination resistor 42. As shown in FIG. 2, when a DC voltage is applied to the metal trace 26, the beam 24 is attracted and makes capacitive contact with the metal trace 26 through a thin layer of an insulator (not shown). The insulator layer is used to prevent the DC bias from being shorted to ground. Thus, applying a voltage to the metal trace 26 results in closing the RF switch to allow RF signals connected between the RF input terminal $RF_{in}$ to be connected to the RF output terminal $RF_{out}$. Similarly, as shown in FIG. 3, applying a DC voltage to the metal trace 28 causes the beam 24 to be deflected in order to make contact with the metal trace 28, thereby opening the connection between the RF input terminal $RF_{in}$ and the RF output terminal $RF_{out}$. The termination resistor 42 can be removed allowing the blocking capacitor to be used to connect to another RF output. In this way the switch becomes a single pole double throw (spdt) switch. The switch illustrated in FIGS. 1–3 relies on a relatively thin layer of a high dielectric layer, such as 50 to 100 nanometers of silicon nitride with relative dielectric constant $\in_r$ of 7, or aluminum nitride ($\in_r$ of 9) material coating on the beam 24 and metal traces 26 and 28 resulting in low reactance in an "on" position. The low dielectric constant of air ($\in_r$ of 1) results in the switch having a high reactance in the "off" position. For such switch, if it is sticking to one side ("sticking on"), a voltage can be applied to the other side to pull it off, thus reduce the "sticking on" problem.

Figure 4A:
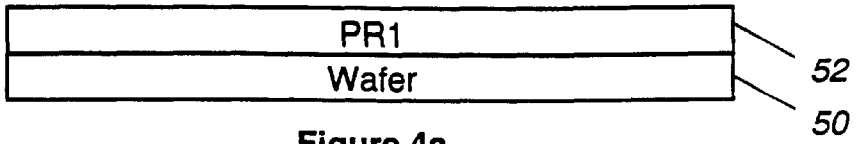
FIGS. 4A–4H illustrate the processing steps for fabricating the switch in accordance with the present invention.
Figure 4B:
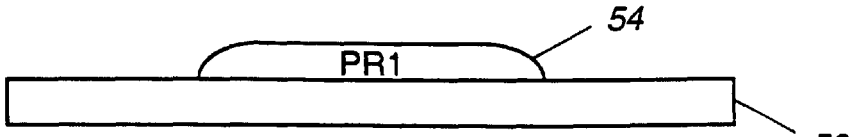
Figure 4C:
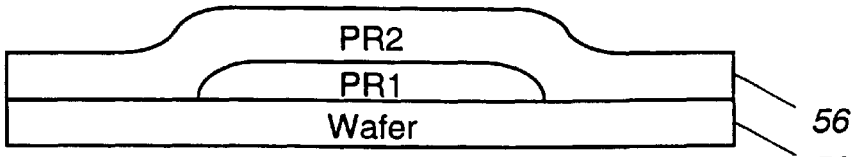
Figure 4D:
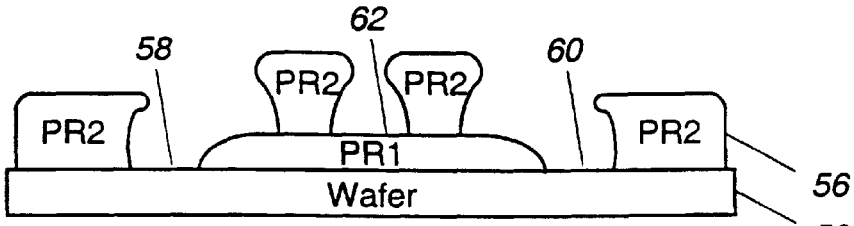
Figure 4E:
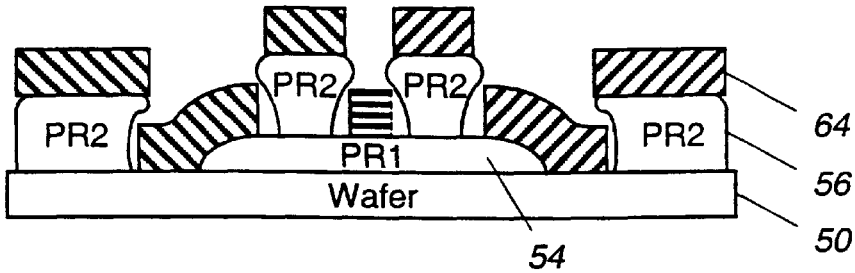
Figure 4F:
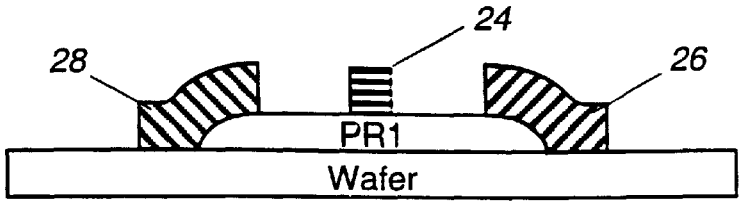
Figure 4G:
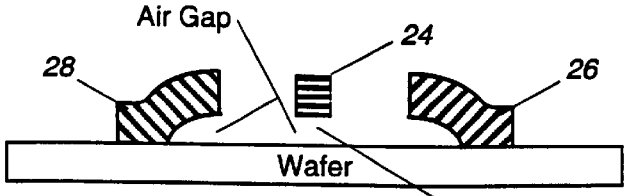
Figure 4H:
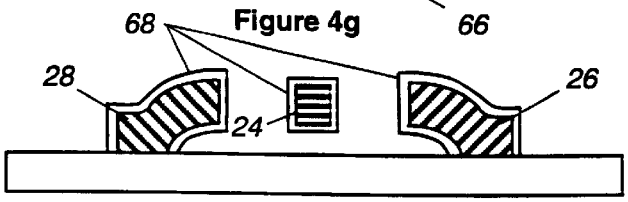

The process diagram for fabricating the switch illustrated in FIGS. 1–3 is illustrated in FIGS. 4A–4H. Although the switch indicated in FIGS. 1–3 is a single pole single throw, it should be clear to one of ordinary skill in the art that the principles of the present invention are applicable to various switch configurations, for example, as illustrated in FIGS. 5 and 6, which have multiple poles and multiple throws all using a single level of metallization, Turning to FIG. 4A, a substrate 50 is provided, such as a (GaAs) or other semiconducting or insulating type substrate. A first photoresist 52 is spun on top of the substrate 50. As will be apparent below, the thickness of the first photoresist 52 determines the size of the air gap beneath the airbridge 24. For example, the thickness of the first photoresist 52 may be 0.3–2 microns. After the first level of photoresist 52 is spun on top of the substrate 50, the first photoresist 52 is exposed and developed by way of conventional photolithography techniques, to create a support 54 for the airbridge metal beam 24 and portions of the electrode 26 and 28 as shown in FIG. 1. In particular, the device is exposed to a high temperature, for example 200° C., so that the edges of the first support 54 become rounded as shown in FIG. 4B. The rounded shape of the first support 54 results in a gradual rise of the bridge 24 and portions of the electrodes 26 and 28 which provides additional mechanical strength of the raised metal as shown in FIG. 4E. The high temperature treatment also prevents the first support 54 from being developed during development of the second photoresist 56. Subsequently, as illustrated in FIG. 4C, a second photoresist 56 is spun on top of the support 54. For example, 2.5 microns of the second photoresist 56 may be spun on top of the support 54 as shown. The second photoresist 56 is exposed and developed by conventional photolithography techniques using a suitable mask to form molds 58, 60 and 62 for the DC pads and the airbridge metal beam 24. As shown in FIG. 4C, the molds 58 and 60 are used for the metal traces 28 and 26, respectively, while the mold 62 is used for the airbridge metal beam 24. After the molds 58, 60 and 62 are formed, a conductive metal layer 64, for example, 2 microns of metal, such as aluminum, is deposited on top of the photoresist 56 as well as in the molds 58, 60 and 62 for the metal traces 28, 26 and the airbridge metal beam 24, respectively, as illustrated in FIG. 4E. Subsequently, in step 4F, the excess metal and photoresist 56 is lifted off by a conventional process such as to soak the substrate in acetone to form the metal traces 28 and 26 and the airbridge metal beam 24. Next, as illustrated in FIG. 4G, the support 54 is removed to define an air gap 66 beneath the airbridge metal beam 24. The support 54 may be removed by oxygen plasma. Lastly, a layer of dielectric material, such as silicon dioxide or silicon nitride 68 is deposited onto the surface of the switch. A typical thickness of the layer is about 50 to 100 nanometers (FIG. 4H). Thus, the switch 20, as illustrated in FIGS. 1–3, is formed utilizing a single level of metallization to provide a single pole single throw switch or single pole double throw in which the deflection of the airbridge metal beam 24 is in a plane generally parallel to the plane of the substrate.

Figure 5A:
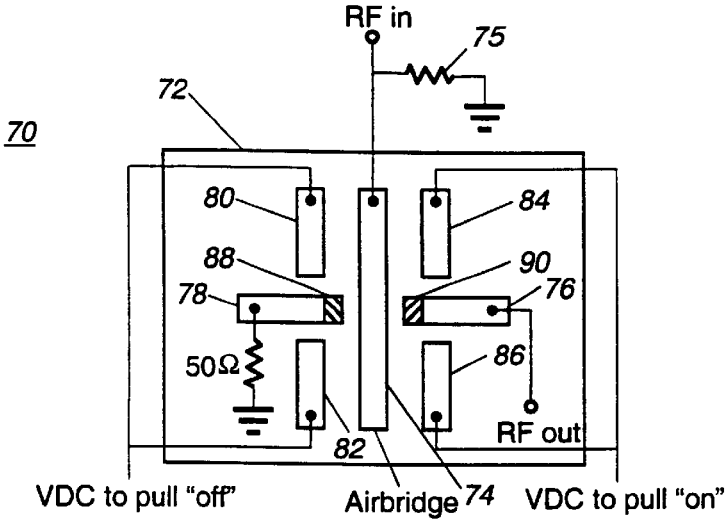
FIG. 5A is a top view of an alternate embodiment of the switch illustrated in FIG. 1.

Alternate embodiments of the switch are illustrated in FIGS. 5A–5D and 6. As discussed above, these embodiments as well as other configurations are amenable to being fabricated using the principles of the present invention in particular to being fabricated using a single metallization layer. Referring to FIG. 5A, an alternate configuration in the switch illustrated in FIG. 1 is illustrated and generally identified with the reference numeral 70. In this embodiment, the switch 70 is formed on substrate 72 and includes an airbridge metal beam 74 disposed between a pair of spaced apart metal traces 76 and 78. In this embodiment, the metal traces 76 and 78 do not have a dual function as the embodiment illustrated in FIGS. 1–3 and are used strictly for the switch contacts. As such, in this embodiment there is no need to have a layer of dielectric material between the airbridge and the contacts to prevent shorting out the DC voltage as in FIG. 1. As shown in FIG. 5A, the metal traces 76 and 78 may be disposed generally perpendicular to the airbridge metal beam 74. An RF input terminal $RF_{in}$ is connected to one end of the airbridge metal beam 74 and terminated by way of an RF choke or termination resistor 75. An RF output terminal $RF_{out}$ is connected to one end of the metal trace 76.

Figure 5B:
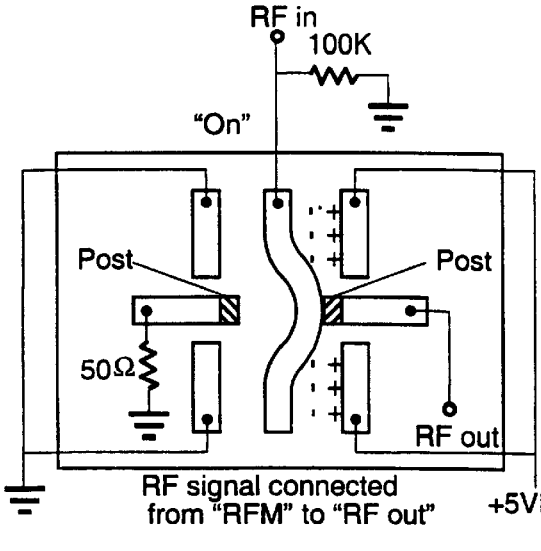
FIG. 5B is a top view of the switch illustrated in FIG. 5A shown with the switch in an on position.
Figure 5C:
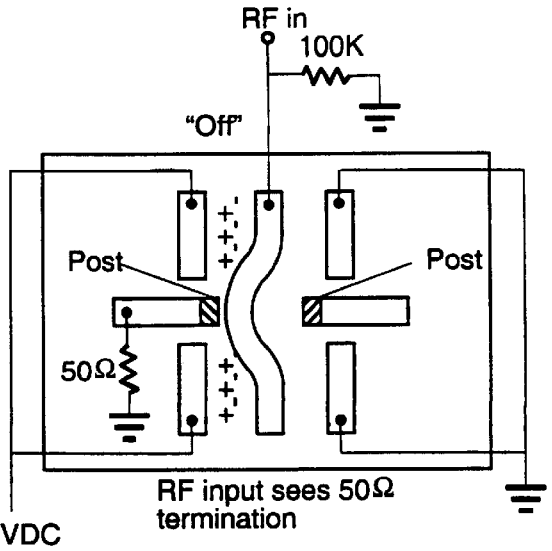
FIG. 5C is similar to FIG. 5B but shown with the switch in an off position.
Figure 5D:
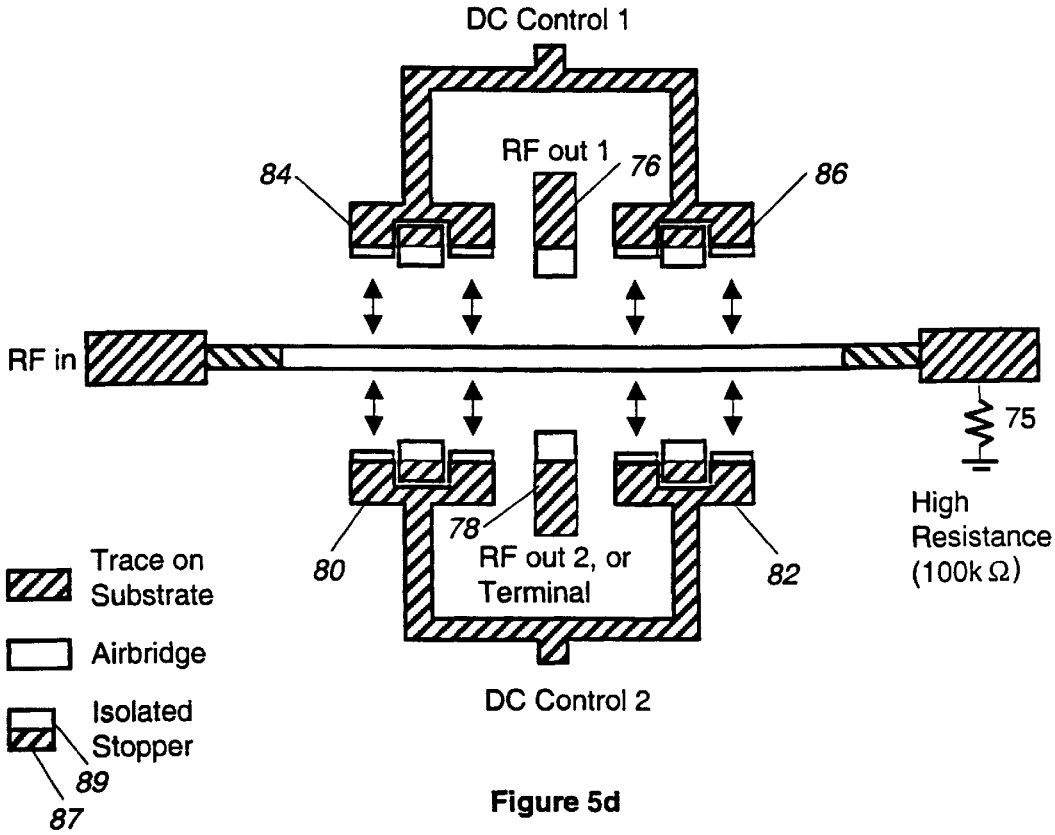
FIG. 5D is similar to FIG. 5A illustrating the use of insulated stoppers in accordance with one aspect of the invention.

In this embodiment, separate control pads 80, 82, 84 and 86 are provided. As shown in FIG. 5A, the control pads 80 and 82 are disposed on one side of the airbridged beam 74 while the control pads 84 and 86 are disposed on the opposite side. A voltage applied to the DC control pads 84 and 86 causes the airbridge metal beam 74 to be deflected towards them as shown in FIG. 5B and contact the metal trace 76 to provide a short circuit between the input terminals $RF_{in}$ and the output terminal $RF_{out}$. Similarly, when a DC voltage is applied to the control contact pads 80 and 82, the airbridge beam 74 is deflected towards 80 and 82 as shown in FIG. 5C to open circuit the connection between the RF input terminal $RF_{in}$ and the RF output terminal $RF_{out}$. Unlike, the switch in FIG. 1 which works as a capacitive switch that cannot pass DC signal, this switch can work for both AC and DC. Again, the "sticking on" problem will be minimized due to the availability of two pairs of control pads, 80, 82, 84, and 86.

In this embodiment, the metal traces 76 and 78 may be formed with posts 88 and 90 on the ends to a height generally equal to the height of the airbridge beam 74. In addition to enabling contact between the airbridge beam 74, the posts 88 and 90 act as stops to prevent the airbridge beam 74 from contacting the DC control pads 80, 82, 84 and 86. To further prevent the airbridge beam 74 from contacting the DC control pads, one or more isolated stoppers 87 can be placed along the DC control pads as showed on FIG. 5D. A portion 89 of the stoppers 87 is raised to the same height as the airbridge beam 74.

An alternate embodiment of the switch is illustrated in FIG. 6. In this embodiment, the switch generally identified with the reference numeral 100, is configured as a single pole six throw switch and includes a plurality of airbridge beams 92, 94 and 96. The airbridge metal beams 92, 94 and 96 are mechanically isolated from one another but are in electrical contact with each other. The airbridge beams 92, 94 and 96 are each disposed between a pair of metal traces 102 and 104, 106 and 108, 110 and 112. Control pads 114, 116, 118, 120, 122, 124, 126, 128, 130, 132, 134 and 136 are disposed on opposing sides of the airbridge beams 92, 94 and 96, respectively. An RF input terminal $RF_{in}$ is connected to one end of the airbridge metal beams 92, 94 and 96. A plurality of RF output terminals, $RF_{out1}$, $RF_{out2}$, $RF_{out3}$, $RF_{out4}$, $RF_{out5}$ and $RF_{out\ 6}$, are connected to each of the metal traces 102, 104, 106, 108, 110 and 112.

Each of the airbridge metal beams 92, 94 and 96 acts in the same manner by electrostatic forces as discussed above. For example, a DC voltage applied to the contact pads 118 and 120 will cause the airbridged level 92 to deflect to the right providing a short circuit between the RF input terminal and the RF output terminal $RF_{out2}$ . Similarly, a DC voltage applied to the control pads 114 and 116 will cause the airbridge beam to deflect to the left causing a short circuit between the RF input terminal and the RF output terminal $RF_{out1}$. The balance of the switch outputs operate in the same manner. The switch shown in FIG. 6 may thus be used as a selector switch to connect an RF input source $RF_{in}$ to any one of the six RF output ports $RF_{out1}$—$RF_{out6}$.

FIGS. 7A and 7B are top views of an airbridge beam 140 for use with the present invention. As shown, the bending stiffness of the bridge 140 can be varied along its lengths if desired for an arbitrary bending shape. As shown in FIGS. 7A and 7B, some portions 142, 144 of the airbridged beam bridge 140 can be formed as a relatively narrow region to form a thin compliant region, while other portions of the bridge portion can be formed as a relatively wider but stiff region. The advantage of it will be lower activation voltage while maintaining the conductivity of the bridge for a given bridge length.

Thus, it should be clear that the process in accordance with the present invention is amenable to forming various RF switches with multiple poles and multiple throws using only a single level of metallization. The fact that separate control sources are required to turn the switch on and off does not require additional levels of metallization.

Obviously, many modifications and variations of the present invention are possible in light of the above teachings. Thus, it is to be understood that, within the scope of the appended claims, the invention may be practiced otherwise than as specifically described above.

We claim:

1. An RF switch comprising:

a substrate;

an electrically conductive beam formed on said substrate as an airbridge, said beam defining a first RF terminal; and one or more metal traces formed on said substrate, disposed adjacent said beam defining one or more second RF terminals, said beam configured to deflect toward and contact said one or more metal traces, said deflection generally in a plane parallel to said substrate forming a closed electrical path between said first RF terminal and said one or more second RF terminals when said electrically conductive beam is in contact with said one or more metal traces.

2. The RF switch as recited in claim 1, wherein said substrate is formed from Gallium Arsenide (GaAs).

3. The RF switch as recited in claim 1, wherein said substrate is formed from an insulating substrate.

4. The RF switch as recited in claim 1, wherein said airbridged beam and said one or more metal traces are formed with a single level of metallization.

5. The RF switch as recited in claim 1, wherein said one or more metal traces are generally parallel to said beam.

6. The RF switch as recited in claim 1, wherein said one or more metal traces are adapted to be connected to an external source of DC.

7. The RF switch as recited in claim 1, wherein said metal traces are generally perpendicular to said beam.

8. The RF switch as recited in claim 7, further including one or more control pads formed on each side of the beam for connection to an external source of DC.

9. The RF switch as recited in claim 1, wherein the width of the beam is not constant.

10. The RF switch as recited in claim 1, wherein said substrate is formed from silicon.

* * * * *